US011333048B1

(12) United States Patent
Roozenboom et al.

(10) Patent No.: US 11,333,048 B1
(45) Date of Patent: May 17, 2022

(54) HYDRO-MECHANICAL MODULE FOR ENGINE VALVE ACTUATION SYSTEM

(71) Applicant: Caterpillar Inc., Peoria, IL (US)

(72) Inventors: Stephan Donald Roozenboom, Washington, IL (US); Jeffrey Clark Krieger, Brimfield, IL (US); Michael Dean Roley, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/126,753

(22) Filed: Dec. 18, 2020

(51) Int. Cl.

| | |
|---|---|
| ***F01L 1/00*** | (2006.01) |
| ***F01L 9/14*** | (2021.01) |
| ***F01L 13/06*** | (2006.01) |
| *F01L 1/08* | (2006.01) |

(52) U.S. Cl.
CPC ..... *F01L 9/14* (2021.01); *F01L 13/06* (2013.01); *F01L 1/08* (2013.01)

(58) Field of Classification Search
CPC ..... F01L 9/10; F01L 9/11; F01L 9/14; F01L 9/16; F01L 9/18
USPC ..... 123/90.12, 90.14, 321, 322
See application file for complete search history.

(56) References Cited

U.S. PATENT DOCUMENTS

| | | | | |
|---|---|---|---|---|
| 4,664,070 | A * | 5/1987 | Meistrick | F02B 69/06 123/21 |
| 6,112,710 | A * | 9/2000 | Egan, III | F01L 13/06 123/90.12 |
| 6,257,183 | B1 * | 7/2001 | Vorih | F01L 13/00 123/90.12 |
| 6,994,069 | B2 | 2/2006 | Hasebe et al. | |
| 7,565,896 | B1 | 7/2009 | Yang | |
| 7,594,485 | B2 | 9/2009 | Harmon | |
| 2005/0274341 | A1 * | 12/2005 | Usko | F01L 1/18 123/90.16 |
| 2019/0101031 | A1 * | 4/2019 | Rabhi | F01L 9/11 |
| 2020/0011257 | A1 | 1/2020 | Stretch et al. | |

FOREIGN PATENT DOCUMENTS

| | | | |
|---|---|---|---|
| CN | 2413027 | Y | 1/2001 |
| CN | 106870055 | B | 7/2019 |
| WO | 9925970 | A1 | 5/1999 |
| WO | 2019151928 | A1 | 8/2019 |

* cited by examiner

*Primary Examiner* — John Kwon

(74) *Attorney, Agent, or Firm* — Brannon Sowers & Cracraft

(57) ABSTRACT

An engine valve actuation system includes a hydro-mechanical valve actuation module having a first hydro-mechanical linkage and a second hydro-mechanical linkage, each within a different housing block of a housing. Each of the first hydro-mechanical linkage and the second hydro-mechanical linkage includes a cam-follower piston in contact with a cam of a camshaft, and a valve-actuation piston hydraulically co-acting with the respective cam-follower piston. The hydro-mechanical valve actuation module may include hydro-mechanical linkages for an intake valve, for an exhaust valve, and for engine braking.

18 Claims, 3 Drawing Sheets

HYDRO-MECHANICAL MODULE FOR ENGINE VALVE ACTUATION SYSTEM

TECHNICAL FIELD

The present disclosure relates generally to an engine valve actuation system, and more particularly to a hydro-mechanical valve actuation module.

BACKGROUND

Modern internal combustion engines typically include multiple engine valve components associated with each combustion cylinder that must be rapidly and reliably moved between open and closed positions during operation. Gas exchange valves, including intake valves and exhaust valves, open and close during engine operation to respectively enable fresh air, and sometimes air mixed with fuel, to be admitted to a cylinder for combustion, and exhaust to be expelled. A camshaft driven in an engine gear train is commonly applied to rotate engine cams in contact with rocker arms that reciprocate to open and close engine valves at desired opening and closing timings. The operating environment of an engine generally, and with regard to gas exchange valves in particular, tends to be quite harsh. Not only are the various components moved relatively rapidly and sometimes with significant force impacts upon valve seats or the like they are also subjected to relatively extreme temperatures and temperature changes. Failure or performance degradation of gas exchange valves in an engine can often require that an associated cylinder be shut down, and in worst case scenarios can result in catastrophic engine failure.

Adding to the complexity and nuances of engine valve and valve actuation system design is the increased interest in recent years in selectively varying opening and closing timings in an effort to optimize efficiency, emissions, and for various other purposes. For these and other reasons engine valve actuation systems are generally designed and built to be quite robust. One known engine valve actuation system is known from U.S. Pat. No. 7,594,485 to Harmon. While the strategy set forth in Harmon certainly has applications, there is always room for improvement and development of alternative strategies.

SUMMARY OF THE INVENTION

In one aspect, an engine valve actuation system includes a camshaft rotatable about a camshaft axis and including a first cam having a first cam profile about the camshaft axis and a second cam having a second cam profile about the camshaft axis different from the first cam profile. The engine valve actuation system further includes a valve actuation module having a housing forming an actuation fluid inlet, a first piston coaction passage, a second piston coaction passage, and a drain. The valve actuation module further includes a first hydro-mechanical linkage having a first cam-follower piston movable within the housing in response to rotation of the first cam, and a first valve-actuation piston movable within the housing to actuate an engine valve, and each of the first cam-follower piston and the first valve-actuation piston having a piston face exposed to an actuation fluid pressure of the first piston coaction passage. The valve actuation module further includes a second hydro-mechanical linkage having a second cam-follower piston movable within the housing in response to rotation of the second cam, and a second valve-actuation piston movable within the housing to actuate an engine valve, and each of the second cam-follower piston and the second valve-actuation piston having a piston face exposed to an actuation fluid pressure of the second piston coaction passage. The engine valve actuation system further includes an electrically actuated control valve movable from a closed position, where the second piston coaction passage is blocked from the drain, to an open position to deactivate the second hydro-mechanical linkage.

In another aspect, a hydro-mechanical valve actuation module for an engine valve actuation system includes a housing forming an actuation fluid inlet, a first piston coaction passage, a second piston coaction passage, and a drain. The valve actuation module further includes, a first hydro-mechanical linkage having a first cam-follower piston movable within the housing in response to rotation of a first cam, and a first valve-actuation piston movable within the housing to actuate an engine valve, and each of the first cam-follower piston and the first valve-actuation piston has a piston face exposed to an actuation fluid pressure of the first piston coaction passage. The valve actuation module further includes a second hydro-mechanical linkage having a second cam-follower piston movable within the housing in response to rotation of a second cam, and a second valve-actuation piston movable within the housing to actuate an engine valve, and each of the second cam-follower piston and the second valve-actuation piston having a piston face exposed to an actuation fluid pressure of the second piston coaction passage. The valve actuation module further includes a first electrically actuated control valve movable from a closed position, where the first piston coaction passage is blocked from the drain, to an open position to deactivate the first hydro-mechanical linkage, and a second electrically actuated control valve movable from a closed position, where the second piston coaction passage is blocked from the drain, to an open position to deactivate the second hydro-mechanical linkage.

In still another aspect, a hydro-mechanical valve actuation module for an engine valve actuation system includes a housing having a first housing block and a second housing block, an actuation fluid inlet formed in the first housing block, and a drain formed in the second housing block. A first hydro-mechanical linkage is within the first housing block and includes a first cam-follower piston movable in response to rotation of a first cam, and a first valve-actuation piston hydraulically co-acting with the first cam-follower piston to actuate an engine valve. A second hydro-mechanical linkage is within the second housing block and includes a second cam-follower piston movable in response to rotation of a second cam, and a second valve-actuation piston hydraulically co-acting with the second cam-follower piston to actuate an engine valve. The valve actuation module further includes a first electrically actuated control valve within the first housing block and movable from a closed position, to an open position to deactivate the first hydro-mechanical linkage, and a second electrically actuated control valve within the second housing block and movable from a closed position, to an open position to deactivate the second hydro-mechanical linkage.

DETAILED DESCRIPTION

Figure 1:
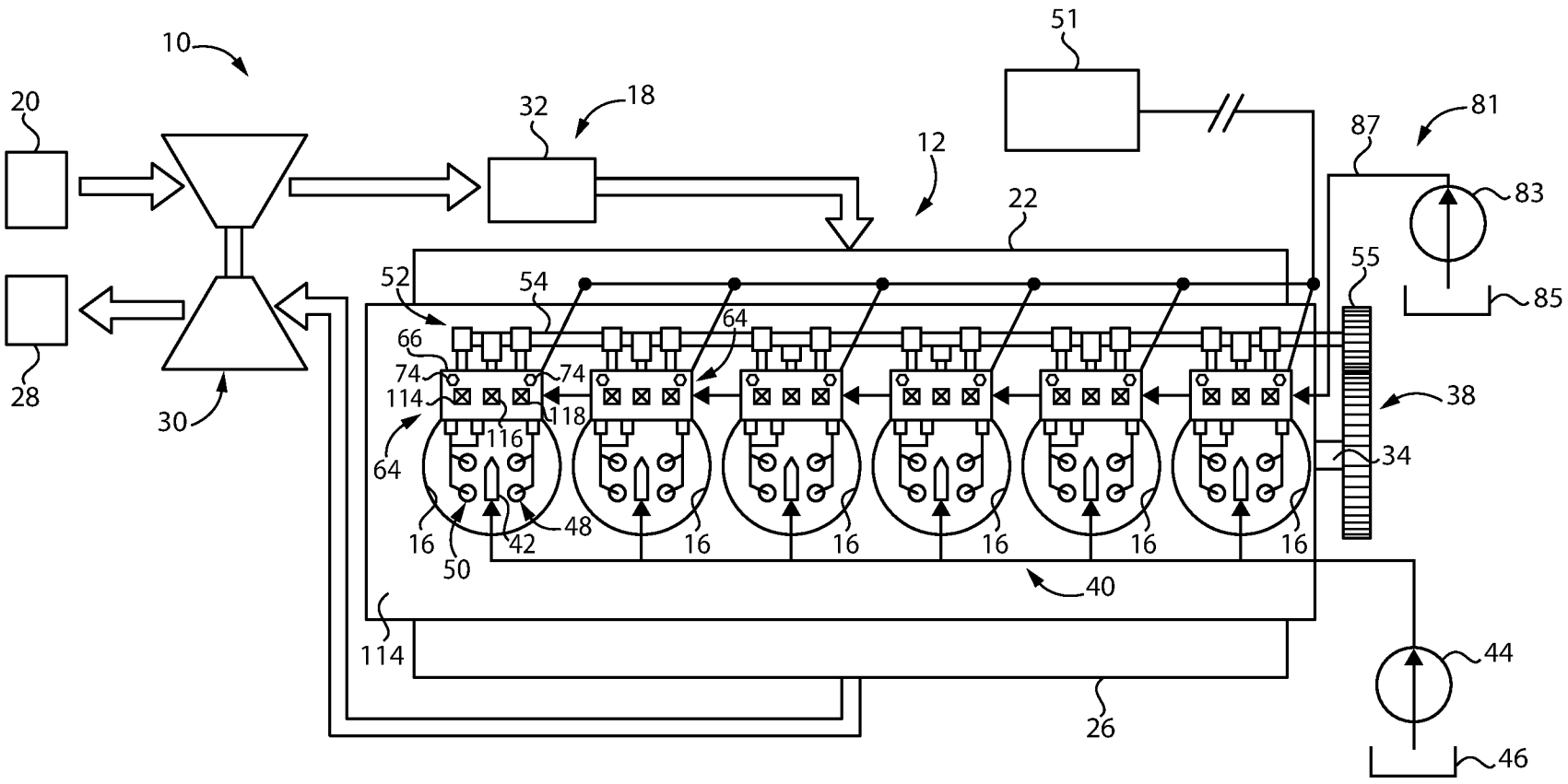
FIG. 1 is a diagrammatic view of an internal combustion engine system, according to one embodiment.

Referring to FIG. 1, there is shown an internal combustion engine system 10 according to one embodiment, and including an engine 12 having an engine housing or cylinder block 14 with a plurality of combustion cylinders 16 formed therein. Combustion cylinders 16 can include any number of cylinders in any suitable arrangement. Internal combustion engine system 10 further includes an intake system 18 structured to deliver intake air, or potentially intake air mixed with fuel, to cylinders 16. Intake system 18 may include an air inlet 20, an intake manifold 22, and an aftercooler 32. A compressor of a turbocharger 30 may be positioned fluidly between air inlet 20 and aftercooler 32. Internal combustion engine system 10 further includes an exhaust system 24 structured to convey exhaust from cylinders 16 to an exhaust manifold 26, and thenceforth to an exhaust outlet 28 after rotating a turbine of turbocharger 30. Emissions aftertreatment equipment (not shown) may treat exhaust in a generally known manner conveyed to exhaust outlet 28. Engine 12 includes a crankshaft 34 structured to operate a gear train 38, also in a generally conventional manner.

Figure 2:
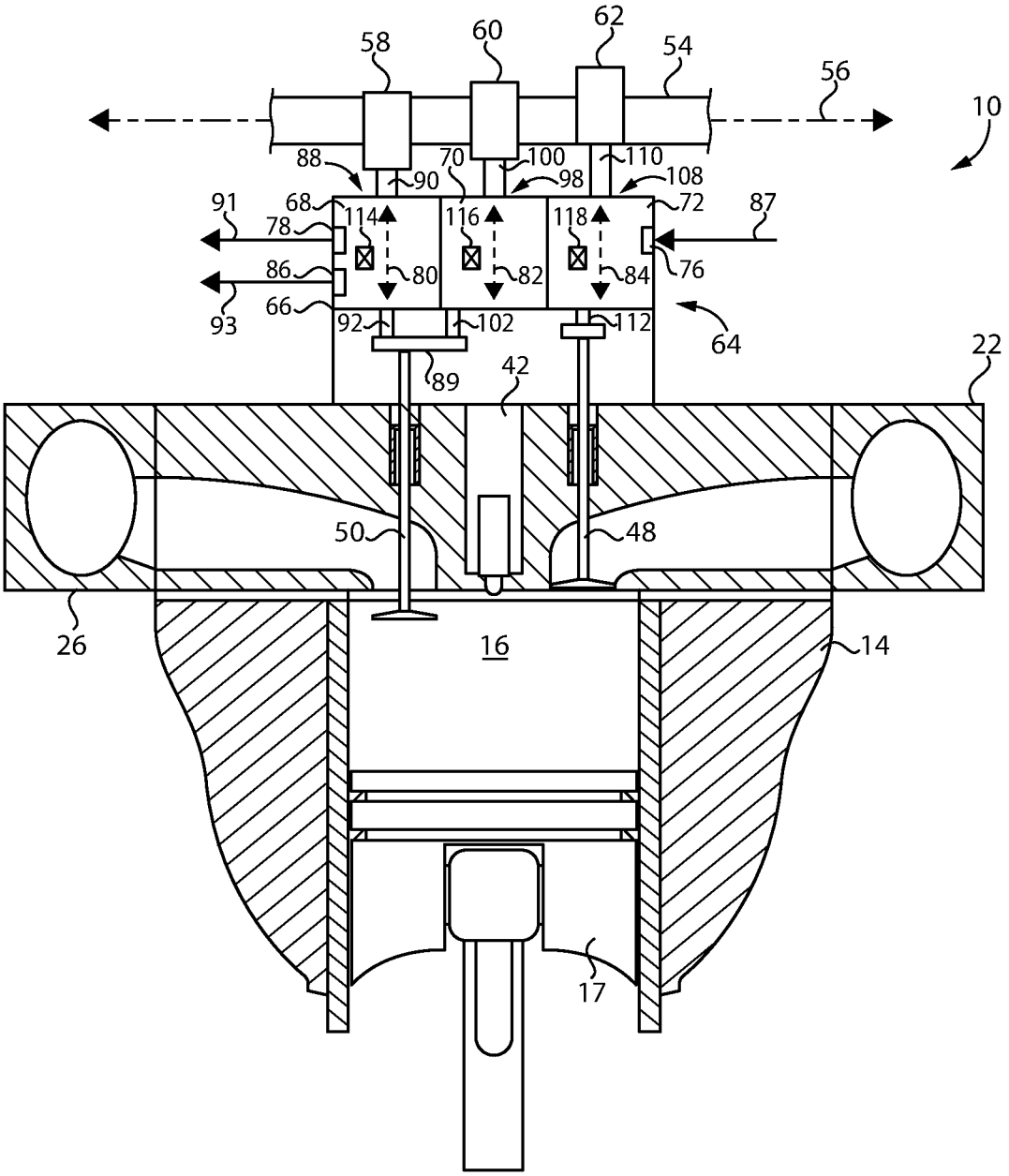
FIG. 2 is a partially sectioned diagrammatic view of a portion of the internal combustion engine system of FIG. 1.

Referring also now to FIG. 2, internal combustion engine system 10 further includes a fuel system 40 having a plurality of fuel injectors 42 each positioned to extend partially into one of cylinders 16, in the illustrated embodiment. Fuel system 40 includes a fuel pump 44, potentially a plurality of fuel pumps such as a low pressure transfer fuel pump and one or more high pressure fuel pumps, and a fuel tank 46. Fuel injectors 42 might receive fuel pressurized and stored in a common reservoir such as a common rail but could alternatively each include a dedicated unit pump. Internal combustion engine system 10 may be a compression-ignition engine system structured to operate on a liquid fuel such as a diesel distillate fuel, however, the present disclosure is also not limited in this regard. A gaseous fuel or gasoline engine that is spark-ignited, a dual fuel engine, a port injected engine, or still other engine configurations are within the scope of the present disclosure. A piston 17 is shown in one of cylinders 16 in the FIG. 2 illustration and movable between a top dead center position and a bottom dead center position, typically in a conventional four-stroke pattern, to rotate crankshaft 34.

As can also be seen from FIG. 1, each cylinder 16 is associated with intake valves 48 and exhaust valves 50. The illustrated embodiment includes a total of two intake valves and a total of two exhaust valves associated with each cylinder 16. Internal combustion engine system 10 further includes an engine valve actuation system 52 for controllably opening and closing intake valves 48 and exhaust valves 50. Engine valve actuation system 52 includes a camshaft 54 rotatable about a camshaft axis 56 and coupled to a cam gear 55 in gear train 38. Camshaft 54 includes a first cam 58 having a first cam profile about camshaft axis 56 and a second cam 60 having a second cam profile about camshaft axis 56 different from the first cam profile. Camshaft 54 may further include a third cam 62 having a third cam profile about camshaft axis 56 different from the first cam profile and the second cam profile. The respective cam profiles may differ in angular orientation about cam shaft axis 56, shape, or both First cam 58, second cam 60, and third cam 62 may each be structured for operating one or more of intake valves 48 and exhaust valves 50 for one of cylinders 16. It will thus be appreciated that each of cylinders 16 may be associated with two cams, three cams, or potentially four cams, for example, the significance of which will be further apparent from the following description.

Engine valve actuation system 52 further includes a plurality of valve actuation modules 64 each associated with one of cylinders 16. Valve actuation modules 64 may be substantially identical to one another, and attached to engine housing 14, such as by bolting to an engine head or other supporting structure attached to a cylinder block. Bolts 74 are shown in FIG. 1 for this purpose. Valve actuation modules 64, hereinafter referred to at times in the singular, each include a housing 66 forming an actuation fluid inlet 76, an actuation fluid outlet 78, a first piston coaction passage 80, a second piston coaction passage 82, and a drain 86. Internal combustion engine system 10 further includes a hydraulic system 81 having a pump 83, a hydraulic tank 85, and a hydraulic supply line 87 structured to feed hydraulic fluid for valve actuation as further discussed herein to each valve actuation module 64. First piston coaction passage 80, second piston coaction passage 82, and potentially a third piston coaction passage 84 receive a flow of actuation fluid from actuation fluid inlet 76 to maintain or replenish actuation fluid discharged to drain 86 during operation and/or leaked out of housing 66. Some actuation fluid may pass from actuation fluid inlet 76 to actuation fluid outlet 78 typically to maintain some positive flow and pressure of actuation fluid through housing 66, and housings of all of valve actuation modules 64. A return line 91 can extend from actuation fluid outlet 78 back to pump 83, to tank 85, or for example to a hydraulic accumulator or the like in hydraulic system 81. A drain line 93 may extend from drain 86 back to tank 85, for example, draining hydraulic actuation fluid from valve actuation module 64 which is expelled during operation as also further discussed herein.

Valve actuation module 64 further includes a first hydro-mechanical linkage 88 having a first cam-follower piston 90 movable within housing 66 in response to rotation of first cam 58. Linkage 88 may also include a first valve-actuation piston 92 movable within housing 66 to actuate an engine valve, for example exhaust valve 50. Valve actuation module 64 further includes a second hydro-mechanical linkage 98 having a second cam-follower piston 100 movable within housing 62 in response to rotation of second cam 60. Linkage 98 also includes a second valve-actuation piston 102 movable within housing 66 to actuate an engine valve, in the illustrated case also for actuating exhaust valve 50. Valve actuation module 64 may still further include a third hydro-mechanical linkage 108 having a third cam-follower piston 110 movable within housing 66 in response to rotation of third cam 62, and a third valve-actuation piston 102 movable within housing 66 to actuate an engine valve, in the illustrated case intake valve 48.

Figure 3:
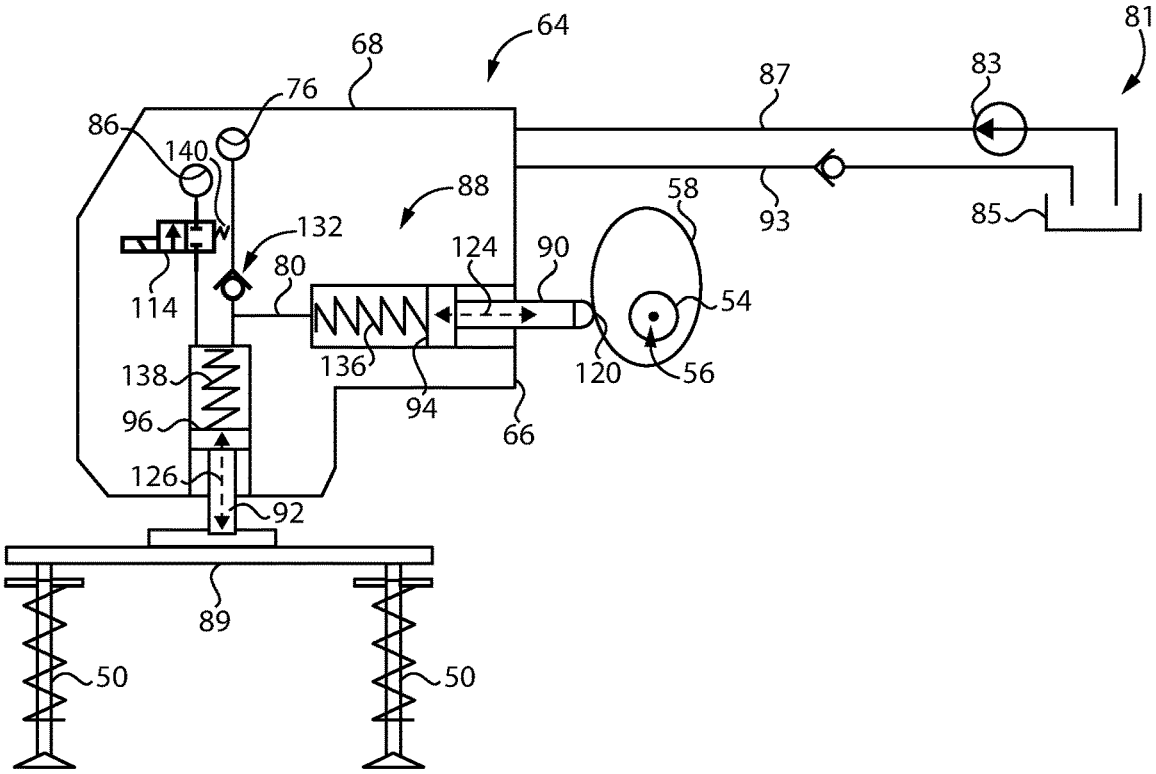
FIG. 3 is a diagrammatic view of a portion of a valve actuation module, according to one embodiment.
Figure 4:
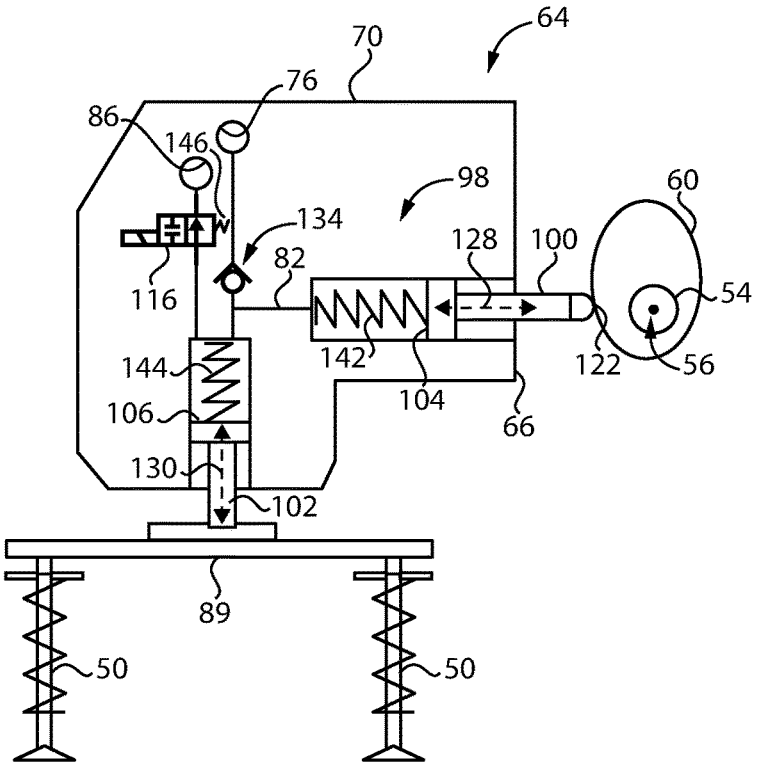
FIG. 4 is a diagrammatic view of a different portion of a valve actuation module, according to one embodiment.

Referring also now to FIGS. 3 and 4, each of first cam-follower piston 90 and first valve-actuation piston 92 may have a piston face 94 and 96, respectively, exposed to an actuation fluid pressure of first piston coaction passage 80. Each of second cam-follower piston 100 and second valve-actuation piston 102 may have a piston face 104 and 106, respectively, exposed to an actuation fluid pressure of second piston coaction passage 82. First valve-actuation piston 92 may be understood as hydraulically co-acting with first cam-follower piston 90. Second valve-actuation piston 102 may be understood as hydraulically co-acting with second cam-follower piston 102. When first cam-follower piston 90 moves into housing 66, leftward in FIG. 3, in response to rotation of first cam 58, first valve-actuation piston 92 responsively advances out of housing 66, down in FIG. 3, by way of displacement of actuation fluid caused by the moving of first cam-follower piston 90. Second cam-follower piston 100 and second valve-actuation piston 102 are analogously hydraulically co-acting. Linkage 108 also provides analogous hydraulic coaction between third cam-follower piston 110 and third valve-actuation piston 112.

Engine valve actuation system 52 further includes an electrically actuated control valve 116, within housing 66, and movable from a closed position, where second piston coaction passage 82 is blocked from drain 86, to an open position to deactivate second hydro-mechanical linkage 98. Engine valve actuation system 52 may further include a second electrically actuated control valve 114, within housing 66, and movable from a closed position, where first piston coaction passage 80 is blocked from drain 86, to an open position to deactivate first hydro-mechanical linkage 88. Engine valve actuation system 52 may still further include a third electrically actuated control valve 118, within housing 66, and movable from a closed position, where third piston coaction passage 84 is blocked from drain 86, to an open position to deactivate third hydro-mechanical linkage 108.

Housing 66 may further include a first housing block 68, a second housing block 70, and a third housing block 72. Actuation fluid inlet 76 may be formed in a first one of the several housing blocks and is illustrated in housing block 72. Drain 86 and actuation fluid outlet 78 may be each be formed in another one of the several housing blocks, and in the illustrated case housing block 68. In other embodiments each of inlet 76, outlet 78 and drain 86, could be the same housing block, or all in the different blocks, for example. It should be appreciated that the terms "first," "second," "third," and like terms are used herein for convenience only, and depending upon reference frame or perspective any one of housing blocks 68, 70, or 72 might be understood as a "first" housing block, a "second" housing block, or a "third" housing block. In the illustrated embodiment, housing block 72 has third hydro-mechanical linkage 98 therein, and forms actuation fluid inlet 76. Housing block 68 has first hydro-mechanical linkage 88 therein and forms both actuation fluid outlet 78 and drain 76. Housing blocks 68, 70, 72, may be separate pieces each having suitable fluid connections therein for supplying actuation fluid to a respective one of piston coaction passages 80, 82, and 84, and conveying drained actuation fluid to drain 86 by way of operation of a respective one of electrically actuated control valves 114, 116, 118, as further discussed herein. Electrically actuated control valves 114, 116, 118, may be within first housing block 68, second housing block 70, and third housing block 72, respectively, although the present disclosure is not thereby limited and valves 114, 116, 118 might be all within the same housing block or even outside of housing 66 in some embodiments. In still other instances, two of valves 114, 116, 118, or all three, might be integrated into one valve member, for instance. Internal combustion engine system 10 may further include an electronic control unit 51 in electronic control communication with electrically actuated control valves 114, 116, 118, and also in electronic control communication with fuel injectors 42, and various of the pumps, sensors, actuators, and other electronic equipment of internal combustion engine system 10.

From the forgoing description and accompanying illustrations, it will be appreciated that engine valve actuation system 52 may have camshaft in an overhead arrangement and may include no rocker arms and no valve lifters for operating intake valves 48 and exhaust valves 50. As illustrated in FIG. 3, first cam-follower piston 90 includes a first follower surface 120 opposite to the respective piston face 94 and in contact with first cam 58, at a location outside of housing 66. Second cam-follower piston 100 include a second follower surface 122 opposite to the respective piston face 104 and in contact with second cam 60, at a location outside housing 66. Housing block 68 is depicted in FIG. 3, and housing block 70 is depicted in FIG. 4. In one embodiment, housing block 68 and the components therein may be substantially identical to housing block 72 and the components therein. It will also be appreciated that housing blocks 68, 70, and 72 may be positioned adjacent to one another, and attached such as by suitable fasteners (not shown), to provide fluid seals therebetween, and installed for service as an integrated unit for operating all the engine valves associated with one of cylinders 16.

Also in the illustrated embodiment, first cam-follower piston 90 and first valve-actuation piston 92 are movable, within housing block 68, along respectively transverse piston axes 124 and 126. Piston axes 124 and 126 may be perpendicular to one another as illustrated, with piston 90 moving left and right in FIG. 3, and piston 92 moving up and down in FIG. 3. The other hydro-mechanical linkage arrangements described herein may function analogously, with second cam-follower piston 100 and second valve-actuation piston 102 movable along respectively transverse piston axes 128 and 130.

It will be recalled that linkage 88 and linkage 98 may each be operationally coupled to one or more exhaust valves 50, and typically two exhaust valves 50 connected by a valve bridge 89. In the illustrated embodiment linkage 108 is operationally coupled to one or more intake valves 48, and typically to two intake valves connected by a valve bridge (not numbered). Electrically actuated control valve 116 may be an engine braking control valve, and electrically actuated control valve 114 may be an exhaust control valve. As can be seen in FIGS. 3 and 4 electrically actuated engine braking control valve 116 is biased towards an open position, by way of a biaser 146, and electrically actuated exhaust control valve 114 is biased towards a closed position, by way of a biaser 140. With control valve 116 in an open position, reciprocation of piston 100 in response to rotation of cam 60 can displace actuation fluid between piston coaction passage 82 and drain 86, through control valve 116. In this configuration linkage 98 is deactivated. When control valve 116 is moved to a closed position, piston 100 reciprocates within housing 66, with the cooperation of a return spring 142, to displace actuation fluid through piston coaction passage 82 which in turn causes movement of piston 102 to actuate exhaust valves 50, in cooperation with a return spring 144. A check valve 134 is positioned fluidly between actuation fluid in let 76 and piston coaction passage 82 and movable to admit actuation fluid to piston coaction passage 82. Piston 90, also in cooperation with a return spring 136, reciprocates within housing 66 to displace a fluid that causes piston 92 to move, in cooperation with a return spring 138, to actuate exhaust valves 50. A check valve 132 is positioned fluidly between actuation fluid inlet 76 and piston coaction passage 80 and movable to admit actuation fluid to piston coaction passage 80. With control valve 114 in a closed position as illustrated, linkage 88 is activated. Moving control valve 114 to an open position fluidly connects piston coaction passage 80 to drain 86, deactivating linkage 88.

INDUSTRIAL APPLICABILITY

Referring to the drawings generally, during operation of engine valve actuation system 52, camshaft 54 is rotated by way of cam gear 55 to rotate cams 58, 60, and 62, in contact with pistons 90, 100, and 110. In the case of normal or non-braking operation, control valve 116 will be positioned in its normal, biased open position, such that linkage 98 is deactivated, and control valve 114 may be in its closed position such that linkage 88 is activated. Linkage 108 will likewise typically be activated by positioning control valve 118 in a biased closed position.

With linkages 88 and 108 activated, and linkage 98 deactivated, exhaust valves 50 and intake valves 80 can open and close at standard opening and closing timings, such as for a conventional four-stroke engine cycle, based on the cam profiles of cams 58 and 62. When it is desirable to initiate engine braking, linkage 98 can be activated and linkage 88 deactivated by suitable positioning of control valves 116 and 114, respectively. Initiating engine braking will vary opening and closing timings of exhaust valves 50 from standard opening and closing timings based on the cam profile of cam 60. In an engine braking mode exhaust valves 50 may open at or close to an end of a compression stroke of piston 17, causing engine 12 to perform work to compress the fluids in cylinder 16, and then releasing the compression, whilst not injecting fuel to produce a combustion reaction. One, two, or potentially all of the valve actuation modules 64 could be operated to engine brake the associated cylinders 16 in internal combustion engine system 10.

In another application, valve actuation module 64 can be used to cut out or deactivate the associated cylinder 16. When cylinder deactivation is desired, control valve 116 can remain in an open position, and each of control valves 114 and 118 can be moved to open positions. In this instance, all three of linkages 88, 98, and 108, will be deactivated such that no gas exchange occurs with the associated cylinder 16, no fuel is injected, and piston 17 compresses and permits expansion of fluids in combustion cylinder 16 without performing net work. Analogous to engine braking, valve actuation modules 64 can be operated to cut out any number of cylinders 16 in engine 12.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine valve actuation system comprising:

a camshaft rotatable about a camshaft axis and including a first cam having a first cam profile about the camshaft axis and a second cam having a second cam profile about the camshaft axis different from the first cam profile;

a valve actuation module including a housing forming an actuation fluid inlet, a first piston coaction passage, a second piston coaction passage, and a drain;

the valve actuation module further including a first hydro-mechanical linkage having a first cam-follower piston movable according to a first timing within the housing in response to rotation of the first cam, and a first valve-actuation piston movable within the housing to actuate an engine valve, and each of the first cam-follower piston and the first valve-actuation piston having a piston face exposed to an actuation fluid pressure of the first piston coaction passage;

the valve actuation module further including a second hydro-mechanical linkage having a second cam-follower piston movable according to a second timing different from the first timing within the housing in response to rotation of the second cam, and a second valve-actuation piston movable within the housing to actuate an engine valve, and each of the second cam-follower piston and the second valve-actuation piston having a piston face exposed to an actuation fluid pressure of the second piston coaction passage; and an electrically actuated control valve movable from a closed position, where the second piston coaction passage is blocked from the drain, to an open position to deactivate the second hydro-mechanical linkage.

2. The valve actuation system of claim 1 wherein:

the first cam-follower piston includes a first follower surface opposite to the respective piston face and in contact with the first cam; and the second cam-follower piston includes a second follower surface opposite to the respective piston face and in contact with the second cam.

3. The valve actuation system of claim 2 wherein:

the first cam-follower piston and the first valve-actuation piston are movable along respectively transverse piston axes; and the second cam-follower piston and the second valve-actuation piston are movable along respectively transverse piston axes.

4. The valve actuation system of claim 2 wherein:

the camshaft includes a third cam having a third cam profile about the camshaft axis different from the first cam profile and the second cam profile; and the valve actuation module further includes a third hydro-mechanical linkage having a third cam-follower piston in contact with the third cam, and a third valve-actuation piston hydraulically co-acting with the third cam-follower piston.

5. The valve actuation system of claim 4 further comprising an engine exhaust valve and an engine intake valve, and each of the first hydro-mechanical linkage and the second hydro-mechanical linkage is operationally coupled to the exhaust valve, and the third hydro-mechanical linkage is operationally coupled to the intake valve.

6. The valve actuation system of claim 1 wherein the electrically actuated control valve includes an engine braking control valve.

7. The valve actuation system of claim 6 further comprising an electrically actuated exhaust control valve movable from a closed position, where the first piston coaction passage is blocked from the drain, to an open position to deactivate the first hydro-mechanical linkage.

8. The valve actuation system of claim 7 wherein the engine braking control valve is biased toward the open position, and the electrically actuated exhaust control valve is biased toward the closed position.

9. The valve actuation system of claim 8 further comprising:

a first check valve located fluidly between the actuation fluid inlet and the first piston coaction passage and movable to admit actuation fluid to the first piston coaction passage;

a second check valve located fluidly between the actuation fluid inlet and the second piston coaction passage and movable to admit actuation fluid to the second piston coaction passage; and an actuation fluid outlet formed in the valve housing and fluidly connected to the actuation fluid inlet.

10. A hydro-mechanical valve actuation module for an engine valve actuation system comprising:

a housing forming an actuation fluid inlet, a first piston coaction passage, a second piston coaction passage, and a drain;

a first hydro-mechanical linkage having a first cam-follower piston movable within the housing in response to rotation of a first cam, and a first valve-actuation piston movable within the housing to actuate an engine valve, and each of the first cam-follower piston and the first valve-actuation piston having a piston face exposed to an actuation fluid pressure of the first piston coaction passage;

a second hydro-mechanical linkage having a second cam-follower piston movable within the housing in response to rotation of a second cam, and a second valve-actuation piston movable within the housing to actuate an engine valve, and each of the second cam-follower piston and the second valve-actuation piston having a piston face exposed to an actuation fluid pressure of the second piston coaction passage;

a first electrically actuated control valve movable from a closed position, where the first piston coaction passage is blocked from the drain, to an open position to deactivate the first hydro-mechanical linkage;

a second electrically actuated control valve movable from a closed position, where the second piston coaction passage is blocked from the drain, to an open position to deactivate the second hydro-mechanical linkage;

the housing further including a first housing block having the first hydro-mechanical linkage and the first electrically actuated control valve therein, and a second housing block attached to the first housing block and having the second hydro-mechanical linkage and the second electrically actuated control valve therein; and the actuation fluid inlet is formed in the first housing block and the drain is formed in the second housing block.

11. The valve actuation module of claim 10 wherein:

the first cam-follower piston and the first valve-actuation piston are movable along respectively transverse piston axes; and the second cam-follower piston and the second valve-actuation piston are movable along respectively transverse piston axes.

12. The valve actuation module of claim 11 wherein:

the respectively transverse piston axes are oriented perpendicular to one another; and each of the first cam-follower piston and the second cam-follower piston includes a follower surface positioned outside of the housing.

13. The valve actuation module of claim 10 wherein an actuation fluid outlet is formed in the housing and fluidly connects to the actuation fluid inlet.

14. The valve actuation module of claim 12 further comprising:

a first check valve located fluidly between the actuation fluid inlet and the first piston coaction passage and movable to admit actuation fluid to the first piston coaction passage; and a second check valve located fluidly between the actuation fluid inlet and the second piston coaction passage and movable to admit actuation fluid to the second piston coaction passage.

15. The valve actuation module of claim 10 wherein the first electrically actuated control valve is biased toward the closed position, and the second electrically actuated control valve is biased toward the open position.

16. A hydro-mechanical valve actuation module for an engine valve actuation system comprising:

a housing including a first housing block and a second housing block, an actuation fluid inlet formed in the first housing block, and a drain formed in the second housing block;

a first hydro-mechanical linkage within the first housing block and having a first cam-follower piston movable in response to rotation of a first cam, and a first valve-actuation piston hydraulically co-acting with the first cam-follower piston to actuate an engine valve;

a second hydro-mechanical linkage within the second housing block and having a second cam-follower piston movable in response to rotation of a second cam, and a second valve-actuation piston hydraulically co-acting with the second cam-follower piston to actuate an engine valve;

a first electrically actuated control valve within the first housing block and movable from a closed position, to an open position to deactivate the first hydro-mechanical linkage;

a second electrically actuated control valve within the second housing block and movable from a closed position, to an open position to deactivate the second hydro-mechanical linkage; and a valve bridge coupled to each of the first valve-actuation piston and the second valve-actuation piston.

17. The valve actuation module of claim 16 wherein:

the first electrically actuated control valve includes an exhaust control valve biased toward the closed position; and the second electrically actuated control valve includes an engine braking control valve biased toward the open position.

18. The valve actuation module of claim 17 wherein the housing further includes a third housing block, a third hydro-mechanical linkage within the third housing block, and an electrically actuated intake control valve biased toward a closed position, and movable to an open position to deactivate the third hydro-mechanical linkage.

* * * * *